United States Patent [19]

Arai et al.

[11] Patent Number: 4,742,328

[45] Date of Patent: May 3, 1988

[54] AUDIO AND VISUAL ALARM DEVICE

[75] Inventors: Tatsuya Arai, Kitamoto; Tadashi Ishii, Kunitachi; Hikoji Iwasaki, Kohnosu, all of Japan

[73] Assignee: Kobishi Electric Co., Ltd., Japan

[21] Appl. No.: 835,558

[22] Filed: Mar. 3, 1986

[30] Foreign Application Priority Data

Mar. 6, 1985 [JP] Japan ..... 60-31805[U]

[51] Int. Cl.[4] ..... G08B 7/00

[52] U.S. Cl. ..... 340/326; 340/815.22

[58] Field of Search ..... 340/326, 328, 815.21, 340/75, 815.22, 88, 327, 396; 116/3; 340/693

[56] References Cited

U.S. PATENT DOCUMENTS

| | | | |
|---|---|---|---|
| 1,032,102 | 7/1912 | Anderson | 340/88 |
| 1,038,206 | 9/1912 | Salisbury | 340/815.22 |
| 1,474,936 | 11/1923 | Lawrence | 340/88 |
| 1,596,216 | 8/1926 | Pangburn | 340/88 |
| 2,109,184 | 2/1938 | Sereda | 340/88 |
| 3,016,478 | 1/1962 | Kadell | 340/81 R |
| 3,781,877 | 12/1973 | Berns | 340/396 |
| 4,101,880 | 7/1978 | Haus | 340/326 |
| 4,241,332 | 12/1980 | Farque | 340/326 |
| 4,274,084 | 6/1981 | Haus | 340/326 |

FOREIGN PATENT DOCUMENTS

| | | |
|---|---|---|
| 475865 | 3/1937 | United Kingdom . |
| 936387 | 3/1960 | United Kingdom . |
| 1462195 | 10/1973 | United Kingdom . |
| 1550338 | 7/1975 | United Kingdom . |
| 1544837 | 3/1976 | United Kingdom . |
| 2064190 | 11/1980 | United Kingdom . |
| 2090450 | 12/1981 | United Kingdom . |

*Primary Examiner*—Joseph A. Orsino
*Assistant Examiner*—Brian R. Tumm
*Attorney, Agent, or Firm*—Darby & Darby

[57] ABSTRACT

An alarm device capable of producing an audible as well as a visual alarm is disclosed. The alarm device comprises a gong, a DC motor of a commutator type and a hammer operatively connected to an output shaft of the motor for striking the gong. The alarm device further comprises a high-voltage generating circuit connected to the motor, a flash tube and an exciter circuit for the tube. When a DC power is supplied to the motor to strike the gong by the hammer, the high-voltage circuit generates a high voltage in accordance with a square-wave current which flows through the motor. The exciter circuit is energized by the high voltage and excites the flash tube to thereby produce flashes of light.

8 Claims, 4 Drawing Sheets

AUDIO AND VISUAL ALARM DEVICE

BACKGROUND OF THE INVENTION

1. Field of the Invention

This invention relates to an alarm device capable of producing an audible as well as a visual alarm.

2. Prior Art

In an emergency in a factory where a considerable amount of noise always exists or in an area where a deaf or a person having difficulty in hearing may present, it will not be sufficient to give an alarm only by an audible signal such as a bell sound. It has therefore been proposed to use in such an area an alarm device which generates a visual alarm signal in addition to an audible alarm signal. However, the conventional alarm device has been a mere combination of an independent audible alarm device such as a bell with an ordinary flashing light. Thus, the conventional alarm device has been relatively expensive and can not have sufficiently covered a desired area by both of the audible and visual alarm signals, i.e., it has been difficult to arrange the audible and visual alarm devices so as not to have exist a dead angle within the desired area.

SUMMARY OF THE INVENTION

It is therefore an object of the present invention to provide an alarm device capable of producing a visual and an audible alarm which is simple in construction and can be manufactured at lower costs.

It is another object of the present invention to provide such an alarm device by which a desired area can be effectively covered by both of the audible and visual alarms.

According to one aspect of the present invention, there is provided an alarm device comprising: a gong; a pair of terminals for being supplied with a DC power; a DC motor of a commutator type for being energized by said DC power applied to said terminals; a hammer operatively connected to said motor for striking said gong; a flash tube; means for generating a high voltage in accordance with a current flowing through said motor; and an exciter circuit energized by said high voltage for exciting said flash tube to produce flashes of light.

DESCRIPTION OF THE PREFERRED EMBODIMENTS OF THE INVENTION

Figure 1:
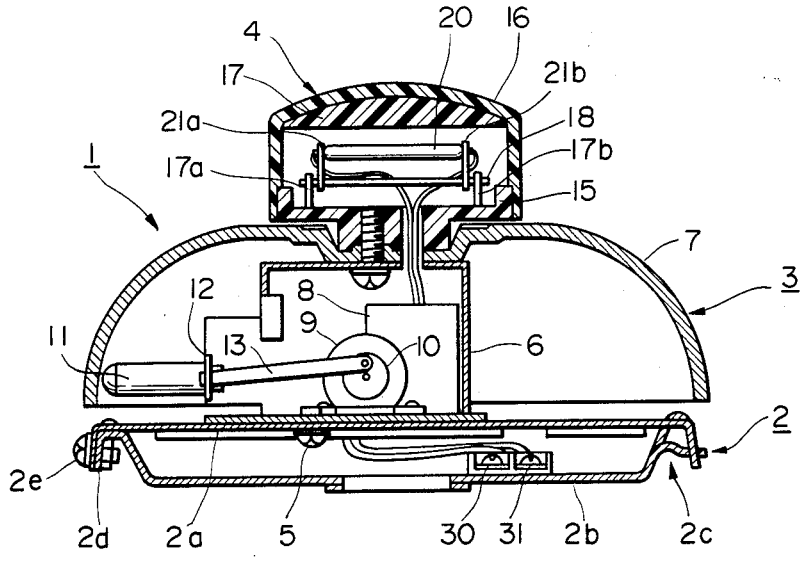
FIG. 1 is a cross-sectional view of an alarm device provided in accordance with the present invention.

FIG. 1 shows an alarm device provided in accordance with the present invention. The alarm device 1 essentially comprises a mounting member 2, a bell unit 3 and a flashing light unit 4. The mounting member 2 is made of a steel sheet and has a base 2*a* of a generally inverted dish-shape with a peripheral flange, a stamped-out mounting portion 2*b*, a hinge portion 2*c* hingedly connecting the base 2*a* and the mounting portion 2*b* together and an engaging portion 2*d* secured to the peripheral flange of the base 2*a* by a screw 2*e*. The bell unit 3 with the flashing light unit 4 is fixedly mounted on the base 2*a* by screws 5. For installing the alarm device 1, the screw 2*e* is first removed so that the mounting portion 2*b* of the mounting member 2 is angularly movable away from the base 2*a* , and then the mounting portion 2*b* is fixedly secured to a mounting surface such as a wall by screws (not shown). Then, the engaging portion 2*d* is secured to the the flange of the base 2*a* by the screw 2*e*.

The bell unit 3 comprises a cup-shaped gong 7 made of metal and a housing 6 mounted on the base 2*a* of the mounting member 2 within the gong 7. Mounted within the housing 6 are an exciter unit 8 for a xenon flash tube and a DC motor 9 of a commutator type. A crank member 10 is mounted on an output shaft of the motor 9. A hammer 11 is supported on a leaf spring 12 mounted on the housing 6, and a link 13 connects the crank member 10 to the leaf spring 12. With this construction, upon rotation of the motor 9, the hammer 11 is intermittently brought into striking engagement with the inner surface of the gong 7 through the crank 10 and the link 13, thereby a bell sound being produced.

The flashing light unit 4 comprises a generally disc-shaped base 15 made of synthetic resin secured to the outer surface of the gong 7 at its central portion. A cup-shaped shell 16 made of translucent synthetic resin is secured to the base 15 at an open end thereof, and a convex lens 17 such as a fisheye lens is attached to the inner surface of an end wall of the shell 16 in opposed relation to the base 15. A pair of lugs 17*a* and 17*b* are mounted on the base 15, and a rod 18 is supported on the lugs 17*a* and 17*b*. A xenon flash tube 20 is mounted on the rod 18 through a pair of links 21*a* and 21*b*.

Figure 2:
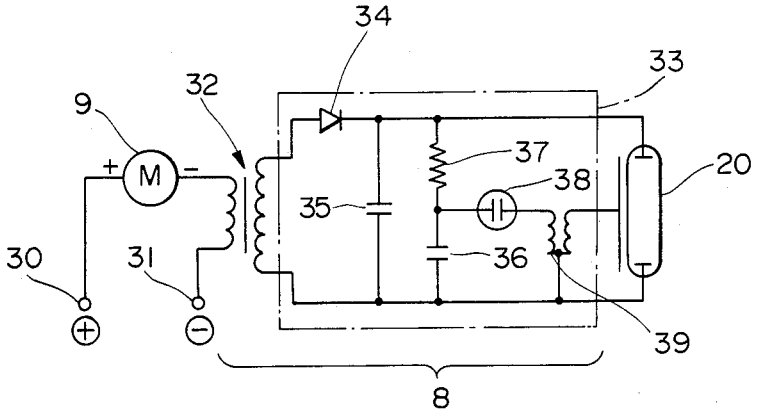
FIG. 2 is a circuit diagram of the exciter unit for the alarm device shown in FIG. 1.

FIG. 2 shows a circuit for exciting the xenon flash tube 20 in accordance with a drive current of the DC motor 9. A positive input terminal of the motor 9 is connected to an electric terminal 30 mounted on the mounting portion 2*b* of the mounting member 2, and a negative input terminal of the motor 9 is connected to another electric terminal 31 through a primary winding of a step-up transformer 32. A DC power of 24 volts is supplied from a control panel (not shown) to the terminals 30 and 31 when an alarm need be generated. A secondary winding of the step-up transformer 32 is connected to a well-known exciter circuit 33 which comprises a diode 34, capacitors 35 and 36, a resister 37, a discharge tube 38 and a trigger transformer 39. The electrodes of the capacitor 35 are connected to corresponding electrodes of the xenon flash tube 20, and an output terminal of the trigger transformer 39 is connected to a triggering electrode of the tube 20.

Figure 3:
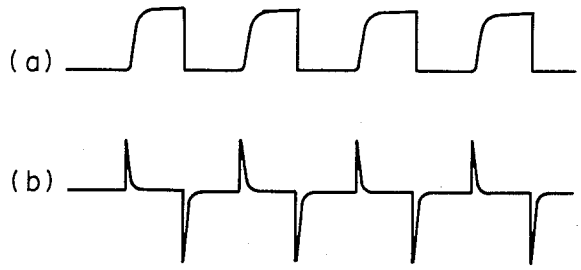
FIGS. 3(*a*), and 3(*b*) are illustrations showing waveforms of the current flowing through the primary winding and of the voltage developing at the secondary winding of the transformer shown in FIG. 2.

With this arrangement, when a power of 24 volts is supplied to the electric terminals 30 and 31, the motor 9 rotates so that the leaf spring 12 is caused to oscillate by the reciprocal motion of the rod 13, whereby the gong 7 is struck by the hammer 11. In this case, a square-wave current shown in FIG. 3(*a*) flows through the primary winding of the transformer 32 since the DC motor 9 is of a commutator type. As a result, a pulse-like voltage shown in FIG. 3(*b*), which has a peak level greater than the level of the DC power, develops at the secondary winding of the transformer 32, and this high voltage charges the capacitor 35 through the diode 34. When the voltage appearing across the capacitor 36 reaches a predetermined level, the discharge tube 38 conducts to trigger the xenon flash tube 20 whereupon the tube 20 produces a flash of light by discharging the capacitor 35. The above operation is repeated to produce flashings of light so long as the terminals 30 and 31 are supplied with the DC power.

Figure 4:
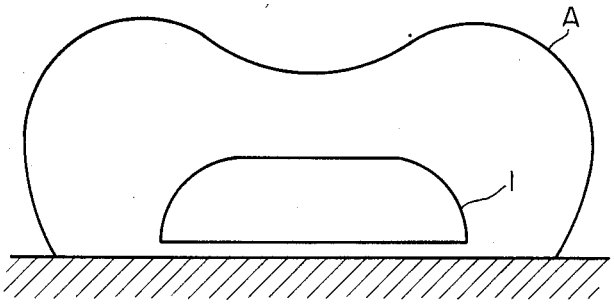
FIG. 4 is an illustration showing the directional characteristics of the bell sound produced by the alarm device shown in FIG. 11.

FIG. 4 shows directional characteristics of the bell sound generated by the above-described alarm device 1, from which it will be appreciated that, in spite of the attachment of the flashing light unit 4 to the bell unit 3, a relatively wide area can be covered by the generated bell sound. The flashes of light emitted from the flash tube can also cover a wide area due to the above-described particular structure of the flashing light unit 4.

Figure 5:
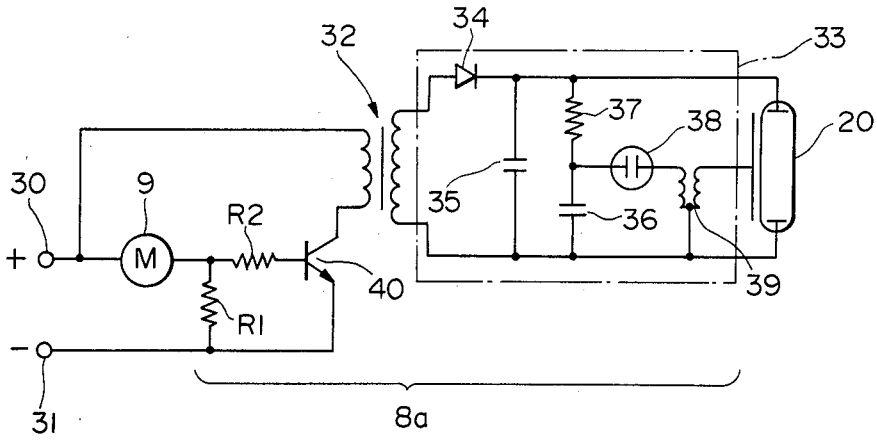
FIG. 5 is a circuit diagram of a modified exciter unit for the alarm device shown in FIG. 1.

FIG. 5 shows a modified exciter unit 8*a* for the alarm device 1 shown in FIG. 1. When a DC power of 24 volts is applied to the terminals 30 and 31, a current similar to that shown in FIG. 3(*a*) flows through the motor 9 and a resistor R1, thereby the motor being driven. A part of the drive current of the motor 9 flows through a resistor R2 into a base of a transistor 40, so that the transistor 40 intermittently conducts. As a result, a square-wave current flows through the primary winding of the transformer 32 and the transistor 40, whereby a high voltage similar to that shown in FIG. 3(*b*) is developed at the secondary winding of the transformer 32, and is applied to the exciter circuit 33 for the xenon flash tube 20.

With the above construction, the high voltage to be applied to the exciter circuit 33 can be more efficiently generated than the circuit shown in FIG. 2.

Figure 6:
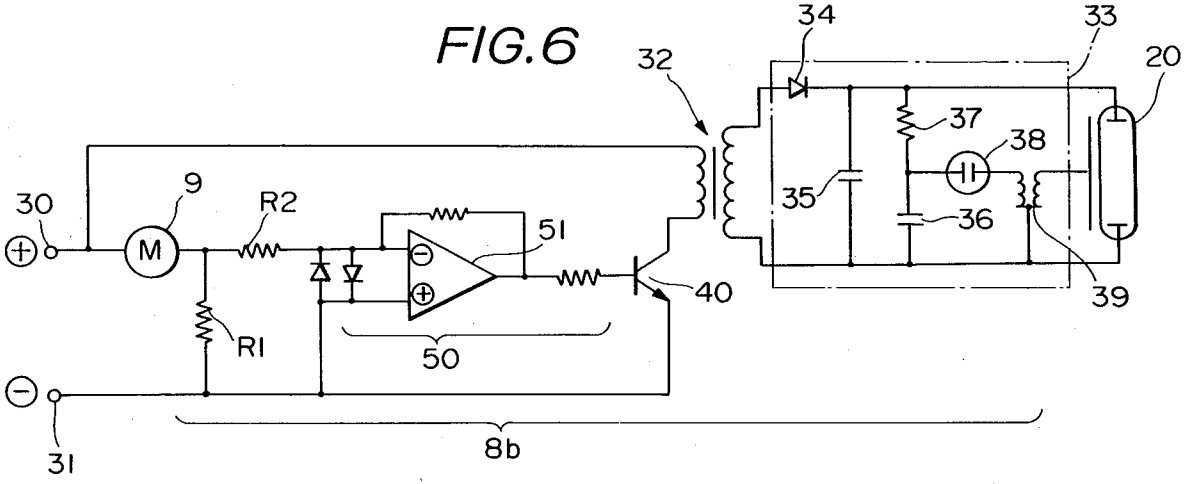
FIG. 6 is a circuit diagram of a further modified exciter unit for the alarm device shown in FIG. 1.

FIG. 6 shows a further modified exciter unit 8*b* for the alarm device 1 which differs from that shown in FIG. 5 in that an amplifier 50 comprising an operational amplifier 51 is provided between the resister R2 and the base of the transistor 40. The operation of this exciter unit 8*b* is almost identical to that of the unit 8*a* shown in FIG. 5.

Figure 7:
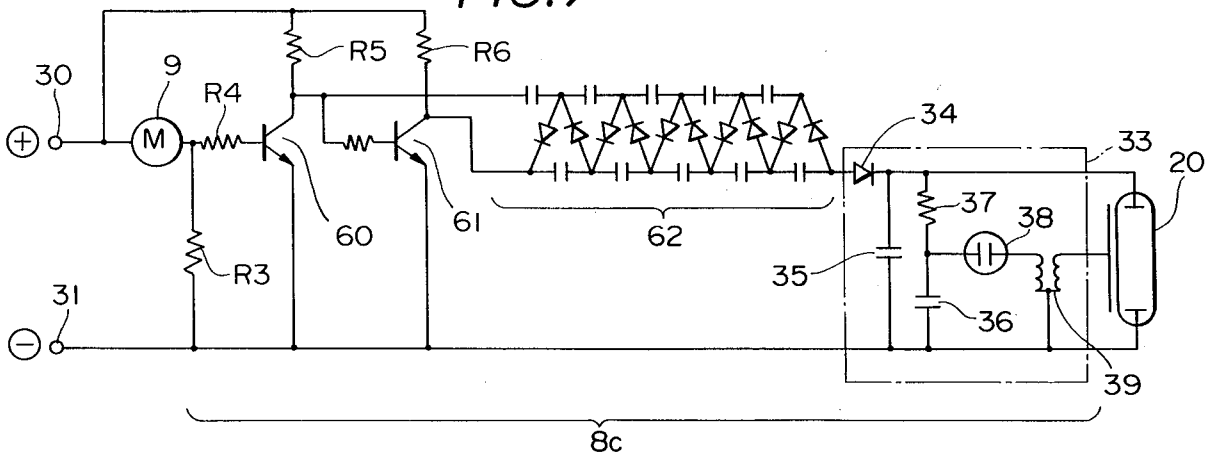
FIG. 7 is a circuit diagram of a still further modified exciter unit for the alarm device shown in FIG. 1.

FIG. 7 shows a still further modified exciter unit 8*c* for the xenon flash tube 20 of the alarm device 1 shown in FIG. 1. The motor 9 and a resister R3 are serially connected between the terminals 30 and 31 so that a motor-drive current flows therethrough when a DC power of 24 volts is supplied to the terminals 30 and 31. The junction point of the motor 9 and the resister R3 is connected through a resister R4 to a base of a transistor 60 so as to allow a part of the drive current of the motor 9 to flow into the base of the transistor 60. A transistor 61 is connected to the transistor 60 in such a manner that one of these transistors 60 and 61 conducts the other is brought into a non-conductive state. Collectors of the transistors 60 and 61 are connected to a well-known rectifier circuit 62 of the voltage multiplier type.

With this arrangement, when the DC power is supplied to the terminals 30 and 31 the motor 9 is driven, and at the same time square-wave voltages opposite in phase to each other appear at the collectors of the transistors 60 and 61. The square-wave voltages are rectified by the rectifier circuit 62, and as a result a high DC voltage is obtained at the capacitor 35. The exciter circuit 33 operates in the same manner as described for the exciter unit 8 shown in FIG. 2.

Figure 8:
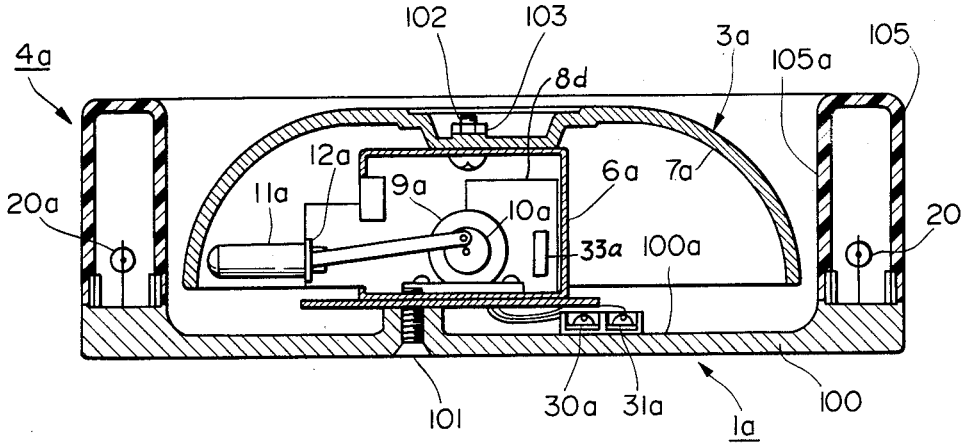
FIG. 8 is a cross-sectional view of a modified alarm device.

FIG. 8 shows a modified alarm device 1*a* provided in accordance with the present invention. This alarm device 1*a* comprises a generally disc-shaped base 100 made of metal, a bell unit 3*a* identical in construction to the bell unit 3 shown in FIG. 1 and an annular flashing light unit 4*a*. A housing 6*a* is fixedly mounted on the base 100 by screws 101, and a gong 7*a* of the bell unit 3*a* is fixedly mounted on the housing 6*a* by a bolt 102 and a nut 103. An exciter unit 8*d* provided within the housing 6*a* differs from the aforesaid exciter units 8*a* to 8*c* in that it has a plurality of exciter circuits 33*a*, 33*a*, . . . (not shown) each having the same construction as that of the exciter circuit 33. The flashing light unit 4*a* comprises an annular member 105 of a channel-shaped cross-section which is mounted on the base 100 at a peripheral margin thereof, the annular member 105 being made of a material permitting light to pass therethrough, that is to say, either a transparent or translucent material. A plurality of xenon flash tubes 20*a*, 20*a*, . . . are mounted on the base 100 and accommodated within the annular member 105. These xenon flash tubes 20*a*, 20*a*, . . . are spaced equally from one another and connected respectively to the corresponding exciter circuits 33*a*, 33*a*, . . . An inner wall surface 105*a* of the annular member 105 cooperates with the surface 100*a* of the base 100 on the side of the bell unit 3*a* to form a recess for efficiently reflecting the bell sound, generated by the gong 7*a*, in the direction away from the surface 100*a*.

With this construction, when a DC power of 24 volts is supplied to terminals 30*a* and 31*a* , the motor 9*a* is driven whereby a bell sound is generated. At the same time, each of the xenon flash tubes 20*a*, 20*a*, . . . is excited by the corresponding exciter circuit 33*a* to produce flashes of light.

Figure 9:
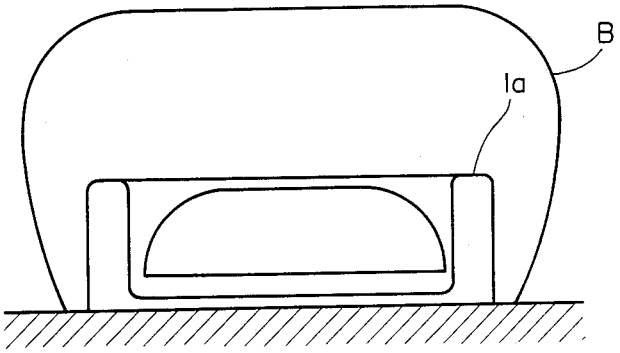
FIG. 9 is an illustration showing the directional characteristics of the bell sound produced by the alarm device shown in FIG. 8.

FIG. 9 shows directional characteristics of the bell sound generated by the above-described alarm device 1*a* from which it will be seen that an alarm by the bell sound can cover a relatively wide area. The flash light unit 105 has an annular shape so that a visual alarm over a relatively wide area can be made by the flashes of light emitted therefrom.

What is claimed is:

1. An alarm device comprising:

(a) a gong;

(b) a pair of terminals for being supplied with a DC power;

(c) a DC motor of a commutator type for being energized by said DC power applied to said terminals;

(d) a hammer operatively connected to said motor for striking said gong;

(e) light emitting means having a flash tube;

(f) means for generating a voltage higher than that of said DC power in accordance with a current flowing through said motor;

(g) circuit means having an exciter circuit energized by said high voltage for exciting said flash tube to produce flashes of light, wherein said means for generating a voltage higher than that of said DC power comprises a shunt circuit provided in a path of said current passing through said motor, a step-up transformer and a transistor, a primary winding of said transformer and said transistor being serially connected between said pair of terminals, said shunt circuit being connected to said transistor in such a manner that said transistor conducts in accordance with a current passing through said shunt circuit, a secondary winding of said transformer being connected to said exciter circuit for energization thereof.

2. An alarm device according to claim 1 further comprising a cup-shaped shell of a material permitting light to pass therethrough and a disc-shaped base for closing an opening of said shell, said going being cup-shaped, said shell being coaxially mounted through said base on said going at an outer surface thereof, said flash tube being mounted on said base and disposed within said shell, said motor, hammer, high-voltage generating means and exciter circuit being mounted within said gong.

3. An alarm device according to claim 2 further comprising a convex lens attached to an inner surface of an end wall of said shell in opposed relation to said base.

4. An alarm device according to claim 1, wherein said light emitting means comprises a plurality of flash tubes, said circuit means having a plurality of exciter circuits energized by said high voltage generating means for exciting said plurality of flash tubes, respectively, said gong being of a cup-shape, and wherein said alarm device further comprises:

a generally disc-shaped base;

a housing fixedly secured to said base for mounting therein said DC motor, high-voltage generating means and exciter circuits, said gong being mounted on said housing in such a manner that said gong accommodates said housing and is disposed in coaxial relation to said base; and an annular member of a channel-shaped cross-section coaxially mounted on said base at a peripheral marginal portion thereof, said annular member being made of a material permitting light to pass therethrough, said plurality of flash tubes being mounted on said base within said base within said annular member and spaced equally from each other.

5. An alarm device comprising:

(a) a gong;

(b) a pair of terminals for being supplied with a DC power;

(c) a DC motor of a commutator type for being energized by said DC power applied to said terminals;

(d) a hammer operatively connected to said motor for striking said gong;

(e) light emitting means having a flash tube;

(f) means for generating a voltage higher than that of said DC power in accordance with a current flowing through said motor;

(g) circuit means having an exciter circuit energized by said high voltage for exciting said flash tube to produce flashes of light, wherein said means for generating a voltage higher than that of said DC power comprises:

a shunt circuit provided in a path of said current passing through said motor;

first and second circuits each having a resistor and a transistor serially connected between said pair of terminals, said first and second circuits being connected to each other in such a manner that when one of the transistors conducts the other of the transistors is brought into a non-conducting state; and a rectifier circuit of the voltage multiplier type connected to respective collectors of said transistors for generating said high voltage.

6. An alarm device according to claim 5 further comprising a cup-shaped shell of a material permitting light to pass therethrough and a disc-shaped base for closing an opening of said shell, said gong being cup-shaped, said shell being coaxially mounted through said base on said gong at an outer surface thereof, said flash tube being mounted on said base and disposed within said shell, said motor, hammer, high-voltage generating means and exciter circuit being mounted within said gong.

7. An alarm device according to claim 6 further comprising a convex lens attached to an inner surface of an end wall of said shell in opposed relation to said base.

8. An alarm device according to claim 5, wherein said light emitting means comprises a plurality of flash tubes, said circuit means having a plurality of exciter circuits energized by said high voltage generating means for exciting said plurality of flash tubes, respectively, said gong being of a cup-shape, and wherein said alarm device further comprises:

a generally disc-shaped base;

a housing fixedly secured to said base for mounting therein said DC motor, high-voltage generating means and exciter circuits, said gong being mounted on said housing in such a manner that said gong accommodates said housing and is disposed in coaxial relation to said base; and an annular member of a channel-shaped cross-section coaxially mounted on said base at a peripheral marginal portion thereof, said annular member being made of a material permitting light to pass therethrough, said plurality of flash tubes being mounted on said base within said annular member and spaced equally from each other.

* * * * *